US006434786B1

(12) United States Patent
Roberts

(10) Patent No.: US 6,434,786 B1
(45) Date of Patent: Aug. 20, 2002

(54) EDGE CLEANING APPARATUS FOR A VACUUM CLEANER

(75) Inventor: Terrance M. Roberts, Fayetteville, AR (US)

(73) Assignee: Oreck Holdings, LLC, Cheyenne, WY (US)

( * ) Notice: Subject to any disclaimer, the term of this patent is extended or adjusted under 35 U.S.C. 154(b) by 16 days.

(21) Appl. No.: 09/708,311

(22) Filed: Nov. 7, 2000

(51) Int. Cl.[7] ..... A47L 5/30
(52) U.S. Cl. ..... 15/364; 15/325; 15/420
(58) Field of Search ..... 15/325, 375, 378, 15/383, 393, 399, 420, 422, 364

(56) References Cited

U.S. PATENT DOCUMENTS 1,965,614 A * 7/1934 Sellers
2,226,371 A * 12/1940 Carlson
2,590,152 A * 3/1952 Buckey
2,607,069 A * 8/1952 Hahn
3,040,365 A * 6/1962 Gerber
3,597,789 A * 8/1971 Boyd
3,608,333 A * 9/1971 Selley et al.
RE28,022 E * 5/1974 Lamont
4,499,628 A 2/1985 Platt
4,685,170 A * 8/1987 Ahlf et al.
5,020,186 A 6/1991 Lessig, III et al.

* cited by examiner

*Primary Examiner*—Terrence R. Till
(74) *Attorney, Agent, or Firm*—Faegre & Benson LLP

(57) ABSTRACT

A front edge cleaning device for an upright vacuum cleaner is disclosed. The front edge cleaning assembly comprises a flexible, resilient member frontally disposed on the head assembly of an upright vacuum cleaner. In one embodiment, the front edge cleaning device includes an elongated section having an upper section and a lower section with front and a rear faces, the rear face of the upper section being attached to the front wall of the vacuum cleaner and the lower section extending downwardly from the upper section and having the front face of the lower section beveled inwardly towards the rear face of the lower section to form an apical lower edge spaced apart from the floor with air openings positioned along the apical lower edge and projecting through the lower section. In another embodiment, the front edge cleaning device includes an elongated section having an upper section and a lower section with front and rear faces, the rear face of the upper section being at least partially attached to the front wall of the vacuum cleaner and the lower section extending downwardly from the upper section and having the front face of the lower section offset inwardly towards the rear face of the upper section to form a lower offset edge spaced apart from the floor with a plurality of air openings positioned along the lower offset edge and projecting through the lower section.

28 Claims, 6 Drawing Sheets

EDGE CLEANING APPARATUS FOR A VACUUM CLEANER

TECHNICAL FIELD

This invention relates generally to methods and apparatuses for collecting particulates from a flow of air transported through a vacuum cleaner.

BACKGROUND OF THE INVENTION

Conventional vacuum cleaners are widely available, and are useful in a number of cleaning applications. One type of vacuum cleaner, commonly known as the upright vacuum cleaner, is frequently used in both residential and commercial settings to remove particulates of various sizes from floor surfaces such as carpeting, wood flooring, or linoleum.

A typical upright vacuum cleaner according to the prior art is shown in FIG. 1. The upright vacuum cleaner 10 is comprised of a handle assembly 112 with a grip 118 mounted thereon. A collector bag assembly 120 is generally frontally positioned on the handle assembly 112 that serves as a receptacle for the collection of particulate matter. The vacuum cleaner 10 is further comprised of a wheel-mounted head assembly 20 pivotally coupled to the handle assembly 112 by a pivot 114. The head assembly 20 may be of any suitable construction, but is generally comprised of a housing with a top portion 202 and front and rear walls 200 and 208 that are joined by side walls 204 and 206. A protective bumper 210 is generally peripherally disposed on the head assembly 20 and projects outwardly from a lower edge of the front wall 200 and the side walls 204 and 206 to protect walls and room furnishings from potentially damaging impacts.

FIG. 2 shows a cutaway side view of the head assembly 20 of the prior art vacuum cleaner 10. As shown therein, the head assembly 20 is further comprised of a transversely extending rotating cylindrical brush 216 that has a plurality of brush elements 218 disposed thereon. The cylindrical brush 216 is generally supported by bearings (not shown) positioned in the side walls 204 and 206, and is rotationally driven by a motor (also not shown) recessed within the head assembly 20. A bottom panel 211 is suitably mounted beneath the housing walls that generally carry a rearwardly disposed set of support wheels 212, and a forwardly disposed set of support wheels 213. The bottom panel 211 is further comprised of an intake nozzle 115 surrounding the rotating brush 216, and positioned substantially close to a floor surface 110. The head assembly 20 is further comprised of a motor-driven blower 220 that is recessed within the head assembly 20 that has an intake opening 222 that is suitably fluidly coupled to the intake nozzle 115. The blower also has an exhaust outlet 224 that is suitably fluidly coupled to the outer bag assembly 120.

In normal use, the user of the upright vacuum cleaner grasps the grip 118 on the handle assembly 112 and reciprocally translates the head assembly 20 across the floor surface 110 while the cylindrical brush 216 rotates and brushes the surface 110 and the blower 220 is developing suction at the intake nozzle 115. Effective removal of particulate matter from the floor surface 110 is thus obtained through the combination of brushing the surface 110 to loosen embedded particulates, suctioning the loosened particulates away from the floor surface 110, and transferring the particulate matter into the collector bag assembly 120.

Although prior art upright vacuum cleaners are relatively efficient in cleaning floor surfaces that are spaced apart from intersecting surfaces, such as walls, baseboards, or portions of room furnishings, a particular difficulty is encountered in using upright vacuum cleaners to clean floor surface regions immediately adjacent to these intersecting surfaces. For example, referring again to FIG. 2, when the front wall 200 of the head assembly 20 is positioned frontally against a wall surface 224, the upright vacuum cleaner is generally unable to effectively clean the near comer region 225 since the vacuum cleaner cannot apply sufficient suction there. This problem is further aggravated by the presence of the protective bumper 210 that projects outwardly from a lower edge of the front wall 200 since the bumper 210 spaces the intake nozzle 115 substantially away from the near comer region 225. Consequently, since there exists an inability to effectively remove particulate debris in the near comer region 225, significant amounts of particulate debris accumulate there that cannot be effectively removed by prior art upright vacuum cleaners.

One attempted solution to this problem has been to provide supplemental openings that direct suction from the nozzle into the near comer region 225. For example, in U.S. Pat. No. 4,499,628 to Platt, an apparatus structured lo selectively open and close a gate located in a front wall of a head assembly is described. In normal operation, the gate remains closed, and the supplemental opening, which is connected to a suction source, is inoperative. When the front wall of a vacuum cleaner head is frontally positioned near the intersecting region of the floor and the wall,; an actuator button contacts the wall and opens the supplemental opening, allowing additional suction to be applied to the near corner region. Although this apparatus is an improvement over the prior art, an inherent shortcoming in this approach is that it requires the installation of the actuator and gate assembly on a front wall of the vacuum cleaner head assembly: Since this area repeatedly sustains physical blows as the head contacts the walls in the room, and room furnishings, the actuator and gate assembly may be easily damaged, and thus rendered inoperable.

Another attempted solution to this problem is described in U.S. Pat. No. 5,020,186 to Lessig, III, et al. As described therein, a rotating brush positioned within a head assembly is disposed immediately adjacent but rearwardly of a front wall of the head assembly. In one embodiment, the front wall is resiliently yieldable to enable the brush to more effectively clean the near comer region when the front wall of the head assembly is pushed against the baseboard, or wall of a room. In another embodiment, the front wall of the head assembly is structured to move upwardly and away from the rotating brush when the head assembly is pressed against a baseboard, or room wall. Although this apparatus similarly constitutes an improvement over prior art vacuum cleaner machines, it disadvantageously allows the rotating brush to contact the room wall surface, which may allow the rotating brush to be damaged as it contacts the surface, or alternatively may lead to damage of the baseboard, wall, or other surfaces that it contacts.

SUMMARY OF THE INVENTION

A front edge cleaning device for an upright vacuum cleaner is disclosed. The front edge cleaning assembly comprises a flexible, resilient member frontally disposed on the head assembly of an upright vacuum cleaner. In one aspect, the front edge cleaning device includes an elongated section having an upper section and a lower section with front and a rear faces, the rear face of the upper section being attached to the front wall of the vacuum cleaner and the lower section extending downwardly from the upper section and having the front face of the lower section beveled inwardly towards the rear face of the lower section to form an apical lower edge spaced apart from the floor with air openings positioned along the apical lower edge and projecting through the lower section. In another aspect, the front edge cleaning device includes an elongated section having an upper section and a lower section with front and rear faces, the rear face of the upper section being at least partially attached to the front wall of the vacuum cleaner and the lower section extending downwardly from the upper section and having the front face of the lower section offset inwardly towards the rear face of the upper section to form a lower offset edge spaced apart from the floor with a plurality of air openings positioned along the lower offset edge and projecting through the lower section.

BRIEF DESCRIPTION OF THE DRAWINGS

FIG. 11 is a horizontal side view of an edge cleaning apparatus according to another embodiment of the invention.

DETAILED DESCRIPTION OF THE INVENTION

The present invention is generally directed to a frontally positioned edge cleaning device for use with an upright vacuum cleaner. Many of the specific details of certain embodiments of the invention are set forth in the following description and in FIGS. 3 through 11 to provide a thorough understanding of such embodiments. One skilled in the art will understand, however, that the present invention may have additional embodiments, or that the present invention may be practiced without several of the details described in the following description.

Figure 3:
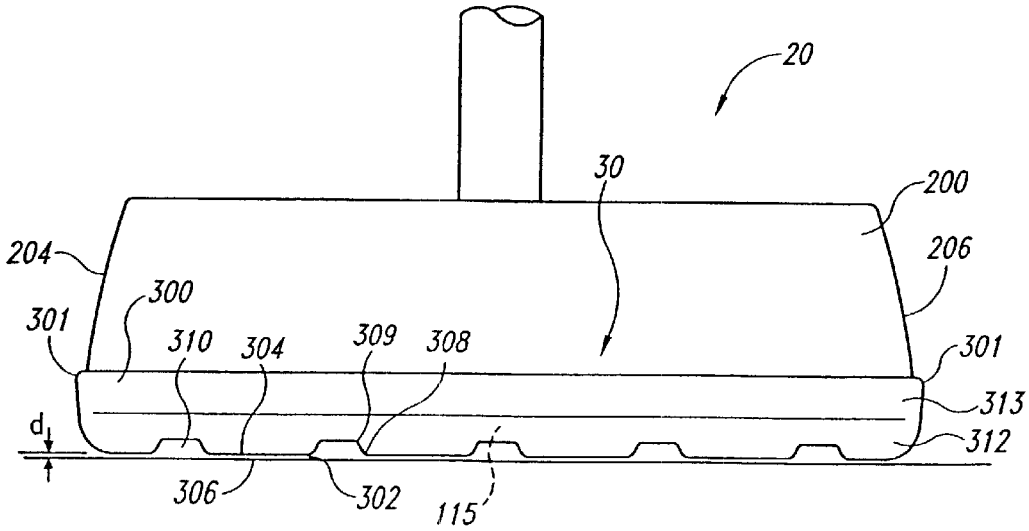
FIG. 3 is a horizontal frontal view of an edge cleaning apparatus according to an embodiment of the invention.

FIG. 3 is a horizontal frontal view of an edge cleaning apparatus 30 according to an embodiment of the invention. As shown therein, the edge cleaning apparatus 30 is comprised of an elongated, substantially flexible and resilient straight portion 300 disposed on the lower edge of the front wall 200 of the head assembly 20. The edge cleaning apparatus 30 also has substantially flexible and resilient curved side portions 301 that are joined to each end of the straight portion 300 that at least partially extend onto the lower edges of the side walls 204 and 206 of the head assembly 20. Although any suitably flexible and resilient material may be used to form the edge cleaning apparatus 30, preferably polyvinylchloride, or a polyurethane material is used. Moreover, the straight portion 300 and curved side portions 301 are preferably formed as a single unitary structure.

Figure 4:
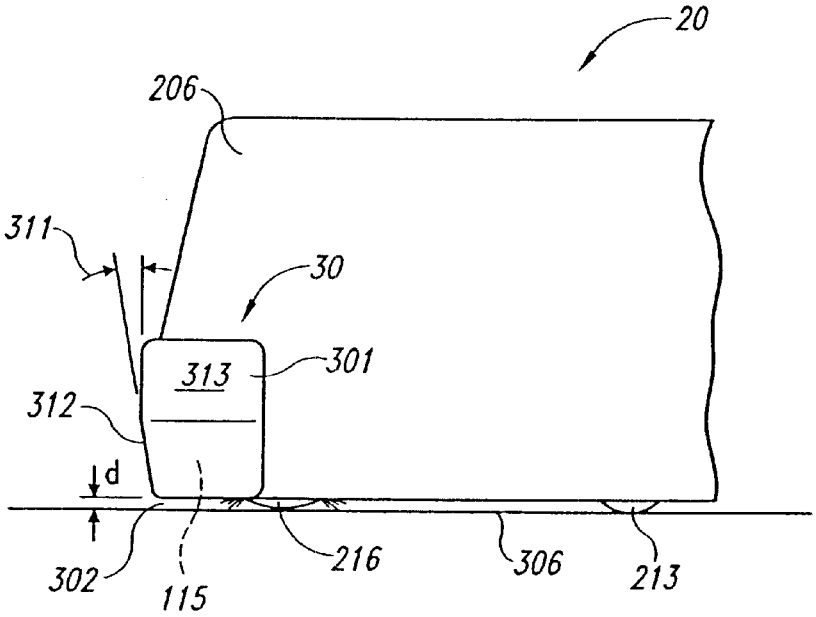
FIG. 4 is a horizontal side view of an edge cleaning apparatus according to an embodiment of the invention.

With reference now to FIGS. 3 and 4, the straight portion 300 and curved side portions 301 have a substantially flat upper portion 313 and a lower beveled portion 312 that projects downwardly from the flat upper portion 313 toward a floor surface 306 to define a lower edge 304 that is substantially parallel with the floor surface 306. As best seen in FIG. 4, the lower beveled portion 312 is beveled inwardly towards the intake nozzle 115 at a bevel angle 311, which is preferably approximately 7.5 degrees, although other inwardly projecting angles may be employed. The lower edge 304 is separated from the floor surface 306 by a distance d to form an air flow gap 302. The air flow gap 302 substantially restricts the flow of air into the intake nozzle 115 within the head assembly 20 to advantageously increase the air velocity through the air flow gap 302 thus improving front edge cleaning performance.

Figure 1:
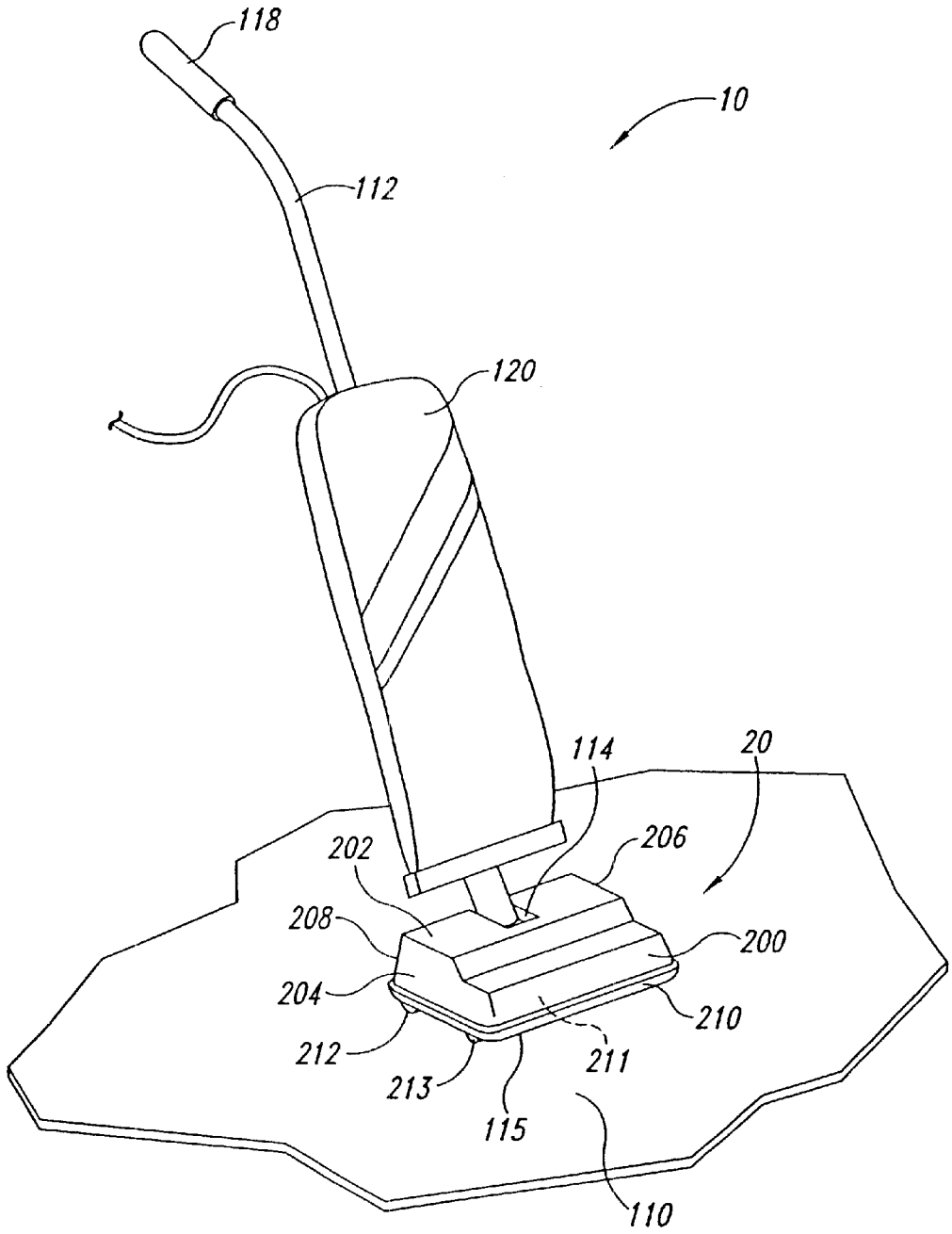
Fig. 1 (Prior Art)
FIG. 1 is an isometric view of an upright vacuum cleaner according to the prior art.
Figure 2:
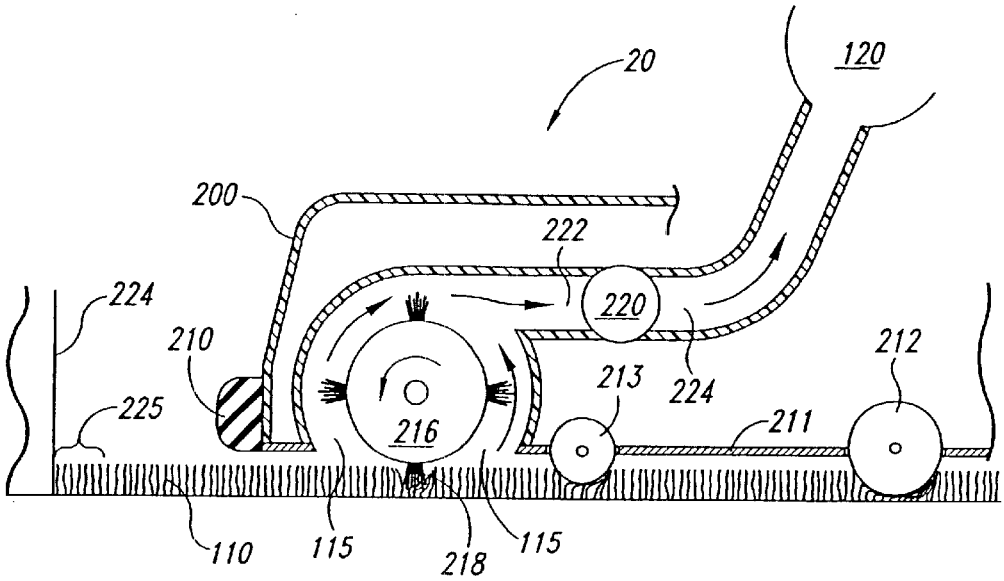
Fig. 2 (Prior Art)
FIG. 2 is a partial side sectional view of an upright vacuum cleaner according to the prior art.
Figure 3A:
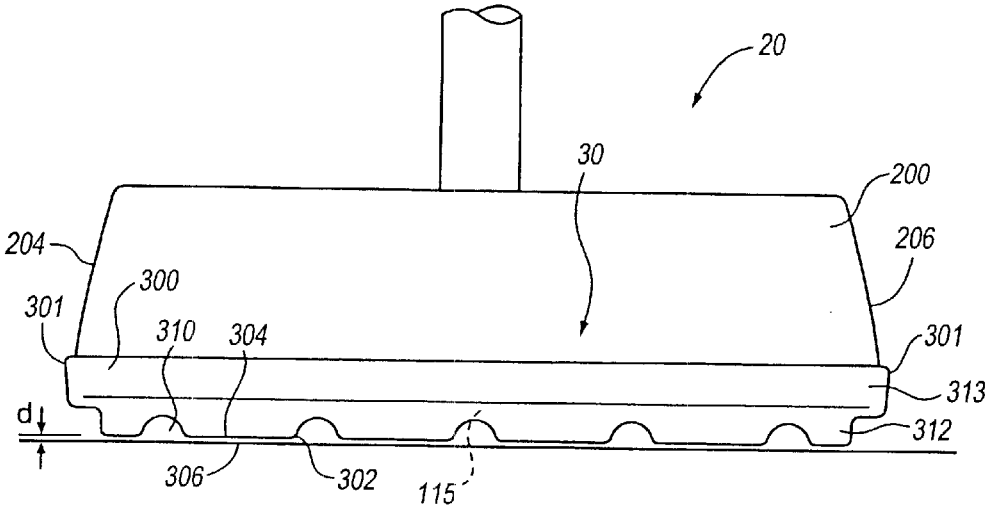
FIG. 3A is a horizontal frontal view of an edge cleaning apparatus according to an alternative embodiment of the invention.
Figure 3B:
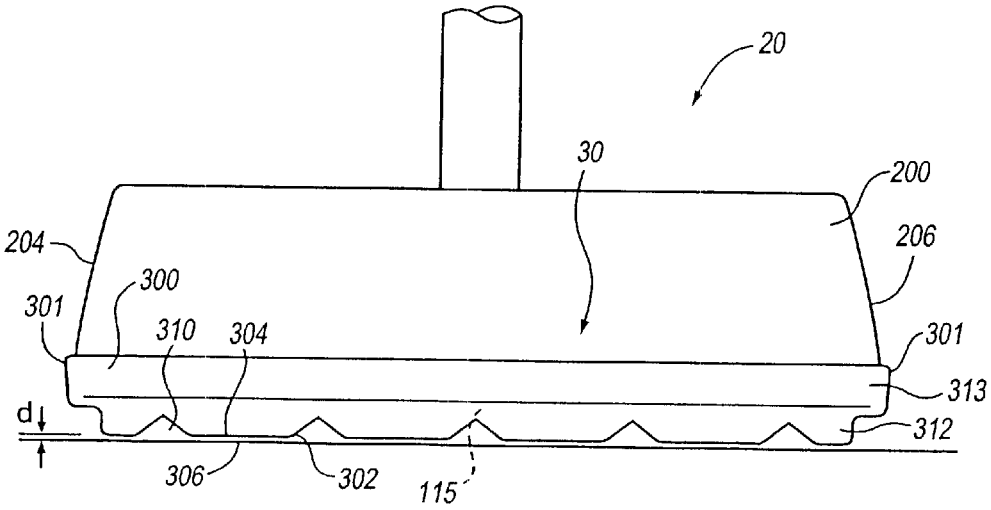
FIG. 3B is a horizontal frontal view of an edge cleaning apparatus according to another alternative embodiment of the invention.

Returning now to FIG. 3, the lower beveled portion 312 is further comprised of a plurality of openings 310 positioned along the lower edge 304 that are spaced apart along the frontal length of the lower beveled portion 312 and project through the beveled portion 312. The openings 310 advantageously permit particulate matter that is too large to be passed through the air flow gap 302 to be ingested into the intake nozzle 115, while preventing other items, such as power cords attached to appliances, or to the machine itself, from coming into contact with the rotating brush 215 (as shown in FIG. 2). Additionally, the openings advantageously allow air to continue to flow into the intake nozzle 115 if the gap 302 becomes too restrictive to permit sufficient air flow into the head assembly 20. For example, the gap 302 may become too restrictive to air flow if the distance d becomes too small, either by height adjustments of the head assembly 20 relative to the floor surface 306, or by irregularities in the floor surface 3065. The openings 310 are preferably substantially rectangular in shape with the inner corners 309 and the lower corners 308 having a superimposed radius, but the openings 310 may be semicircular, triangular, or may have still other regular shapes (as shown in FIGS. 3A and 3B). Moreover, the position of the openings 34210, and the total number of openings 310 positioned along the lower edge 304 may be varied to optimize edge cleaning performance.

Figure 5:
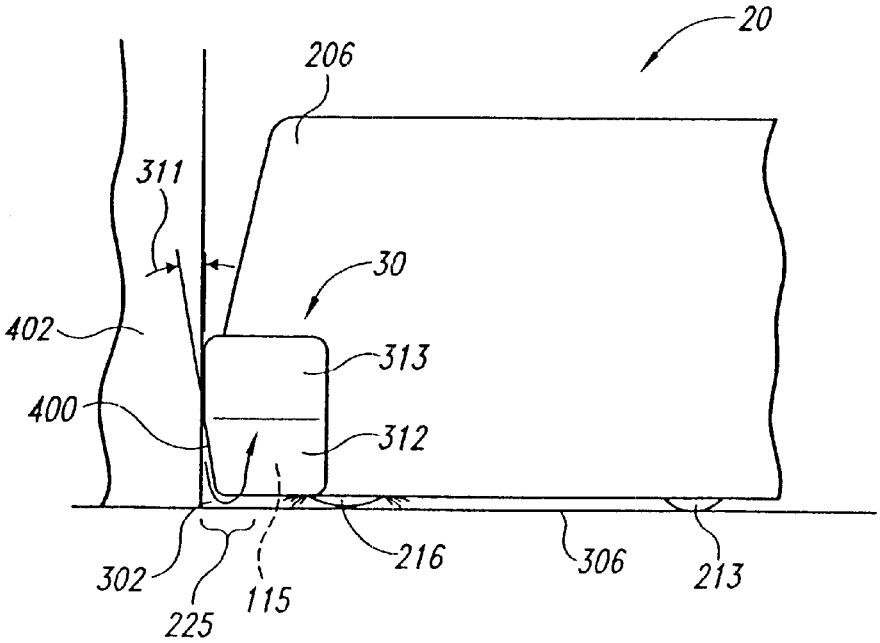
FIG. 5 is a partial horizontal side view of an edge cleaning apparatus according to an embodiment of the invention.

FIG. 5 shows a side view of the edge cleaning apparatus 30 disposed on a head assembly 20 that is positioned adjacent to a wall surface 402. As shown therein, the inwardly projecting bevel angle 311 of the lower beveled portion 312 advantageously allows a clearance space 400 to be formed when the flat upper portion 313 contacts the wall surface 402. The clearance space 400 advantageously allows air to be suctioned into the intake nozzle 115 from the near corner region 225 by permitting air to flow through the clearance space 400 and into the intake nozzle 115. The air velocity in the clearance space 400 may be advantageously controlled through the preferential selection of the width of the air flow gap 302, and the inwardly projecting bevel angle 311 of the lower beveled portion 312, in order to optimize edge cleaning performance.

Figure 6:
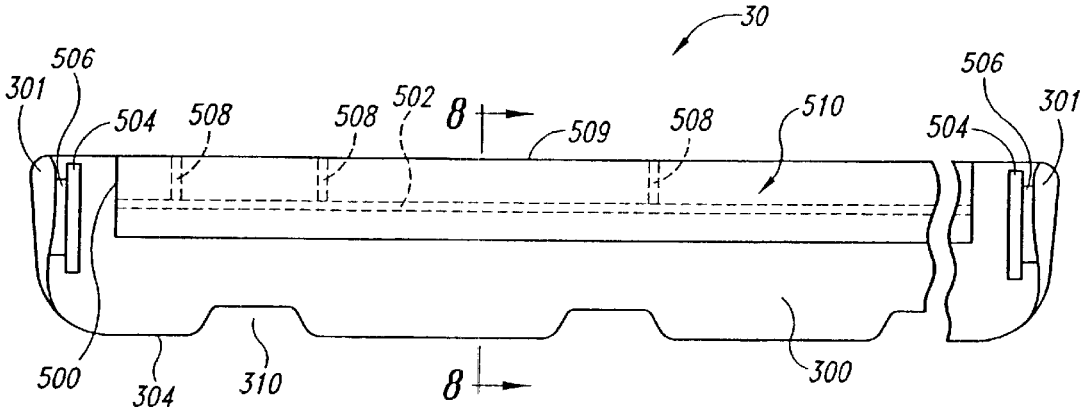
FIG. 6 is a rear plan view of an edge cleaning apparatus according to an embodiment of the invention.
Figure 7:
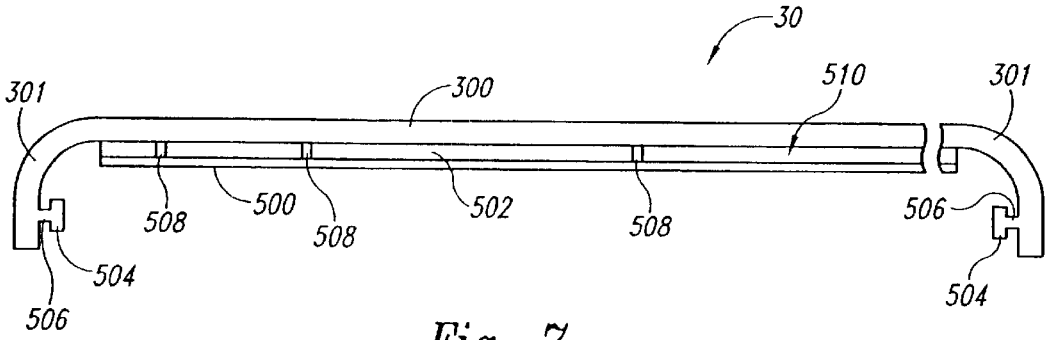
FIG. 7 is a top plan view of an edge cleaning apparatus according to an embodiment of the invention.

Turning now to FIG. 6, a rear plan view of the edge cleaning apparatus 30 shows the edge cleaning apparatus 30 being further comprised of a resilient frontal retaining portion 500 that is positioned away from the rear surface of the straight portion 300, and extending substantially along the length of the rear surface of the straight portion 300. The frontal retaining portion 500 further extends from a medial position on the rear surface of the straight portion 300 to substantially the upper edge 509 of the straight portion 300. The frontal retaining. portion 500 is attached to the rear surface of the straight portion 300 by a resilient frontal coupling portion 502 to form a gap 510 between the rear surface of the straight portion 300 and the frontal retaining portion 500. Reinforcing portions 508 are disposed in the gap 510 at selected intervals and extend from the frontal coupling portion 502 to the upper edge 509 to further reinforce the frontal coupling portion 502. The curved side portions 301 are similarly comprised of a side retaining portion 504 that is attached to the rear surface of the curved side portion 301 by a side coupling portion 506. FIG. 7 shows a top view of the edge cleaning apparatus 30 that further depicts the frontal retaining portion 500 and the frontal coupling portion 502 disposed on the rear surface of the straight portion 300. Also shown in FIG. 7 is a further depiction of the side retaining portion 504 and side coupling portion 506 that are disposed on the rear surface of the curved side portions 301.

Figure 8:
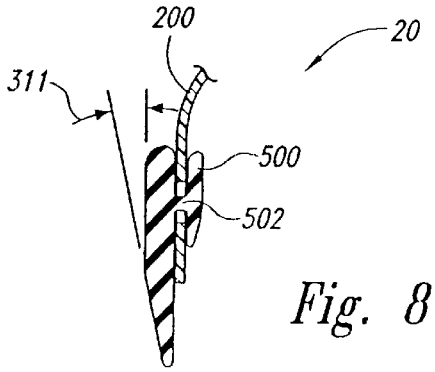
FIG. 8 is a partial cross sectional view of an edge cleaning apparatus according to an embodiment of the invention.

FIG. 8 shows a cross sectional view of the edge cleaning apparatus 30, corresponding to the cross sectional cut shown in FIG. 6, disposed on the front wall 200 of the head assembly 20. As shown therein, a front wall mounting slot 551 projects through the front wall 200 and is suitably dimensioned to receive the frontal coupling portion 502 yet too small to allow the frontal retaining portion 500 to pass through when in a non-deformed condition. Additionally, the front wall mounting slot includes perpendicular intersecting slots (not shown) suitably dimensioned to receive the reinforcing portions 508. When installing the straight portion 300 onto the front wall 200 of the vacuum cleaner head assembly 20, the frontal retaining portion 500 is resiliently deformed and urged though the mounting slot 551. After the frontal retaining portion 500 has passed entirely through the slot 551, the frontal retaining portion 500 returns to its undeformed shape to lock the straight portion 300 in place. Side portions 301 are similarly installed on the side walls 204 and 206 by resiliently deforming the side retaining portion 504 and urging it through suitably dimensioned slots (not shown) in the side walls 204 and 206 of the vacuum cleaner head assembly 20. After the side retaining portion 504 has passed through the slot, it similarly returns to its undeformed shape to lock the side portions 301 in place. Although the present embodiment describes the use of retaining portions disposed on the rear surfaces of the edge cleaning apparatus 30, other attachment methods may be used. For example, the straight portion 300 and curved side portions 301 may be adhesively bonded to the front wall 200, and side walls 204 and 206 of the head assembly 20. Alternatively, the straight portion 300 and curved side portions 301 may be attached to the front wall 200, and side walls 204 and 206 of the head assembly 20 by suitably recessed screws, or other fastening devices.

Figure 9:
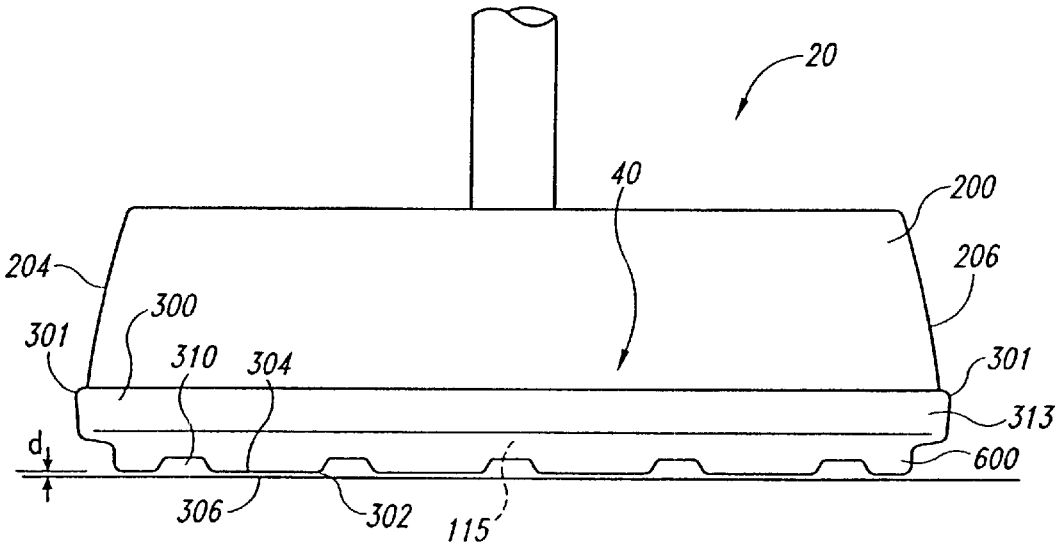
FIG. 9 is a horizontal frontal view of an edge cleaning apparatus according to an embodiment of the invention.

FIG. 9 is a horizontal frontal view of an edge cleaning apparatus 40 according to another embodiment of the invention. As in the previous embodiment, the edge cleaning apparatus 40 is comprised of an elongated, substantially flexible and resilient straight portion 300 disposed on the lower edge of the front wall 200 of the head assembly 20. The edge cleaning apparatus 30 also has substantially curved side portions 301 that are joined to each end of the straight portion 300 that at least partially extend onto the lower edges of the side walls 204 and 206 of the head assembly 20. Although any suitably flexible and resilient material may be used to form the edge cleaning apparatus 40, preferably polyvinylchloride, or a polyurethane material is used. Additionally, the straight portion 300 and curved side portions 301 are preferably formed as a single unitary structure.

Figure 10:
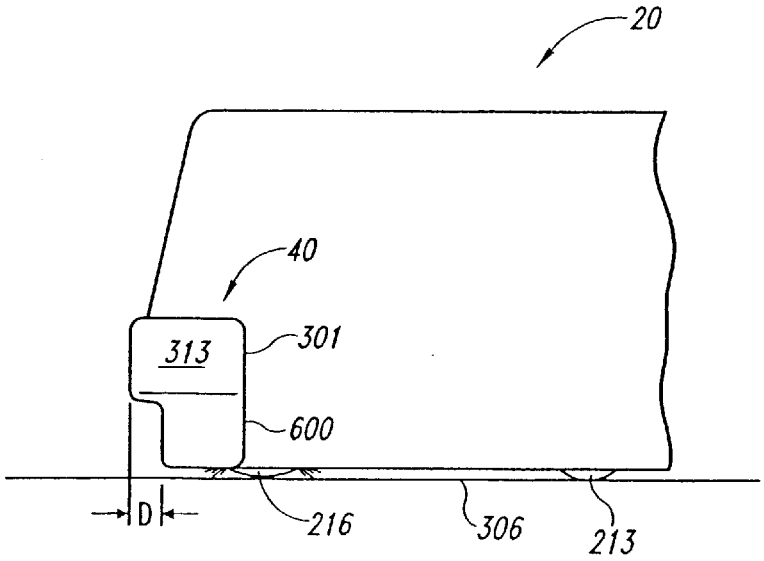
FIG. 10 is a horizontal side view of an edge cleaning apparatus according to another embodiment of the invention.

Referring now to FIGS. 9 and 10, the straight portion 300 and curved side portions 301 have a substantially flat upper portion 313 and a lower offset portion 600 that projects downwardly from the flat upper portion 313 toward a floor surface 306 to form a lower edge 304 that is substantially parallel with the floor surface 306. Referring to FIG. 10, the lower offset portion 600 is displaced inwardly towards the intake nozzle 115 a distance D. The lower edge 304 is separated from the floor surface 306 by a distance d to again form an air flow gap 302. As in the previous embodiment, the edge cleaning apparatus 40 will similarly allow substantial air movement in the near corner region, thereby increasing edge cleaning performance.

Unlike prior art edge cleaning devices that may be damaged by repeated impacts with wall or room furnishings, the various embodiments of the edge cleaning apparatus are durable, resilient devices capable of sustaining blows with no effect on performance. Moreover, the edge cleaning capability of the various embodiments may be adapted to a variety of floor surfaces by adjusting the height of the lower edge of the embodiments above the floor surface through conventional height adjustment devices commonly employed to set the height of the rotating brush. Finally, since the various embodiments of the edge cleaning apparatus are fabricated from a resilient material, the possibility of damage to underlying floor surfaces, or to baseboard surfaces, walls or furniture objects is minimized.

The above description of illustrated embodiments of the invention is not intended to be exhaustive or to limit the invention to the precise form disclosed. While specific embodiments of, and examples of, the invention are described in the foregoing for illustrative purposes, various equivalent modifications are possible within the scope the invention, as those skilled in the relevant art will recognize. For example, the various embodiments described above may be equally applicable to other types of floor cleaning devices. Moreover, the various embodiments described above can be combined to provide further embodiments. Accordingly, the invention is not limited by the disclosure, but instead the scope of the invention is to be determined entirely by the following claims.

what is claimed is:

1. An upright vacuum cleaner for leaning a floor surface, comprising:

a wheel-mounted head assembly with a front wall and two side walls and containing a floor brush rotatable about an axis parallel to the floor surface adapted to dislodge debris from the floor surface, an intake nozzle extending substantially along the length of the floor brush, and an air blower having an inlet and an outlet, the inlet being fluidly connected to the intake nozzle to remove debris dislodged from the floor surface;

a handle assembly pivotally attached to the head assembly for translating the head assembly across the floor surface;

an outer bag assembly attached to the handle assembly and having an internal volume that is fluidly connected to the blower outlet, the bag assembly being adapted to collect debris removed from the floor surface;

a flexible, resilient edge cleaning member disposed on a lower portion of the front wall extending along the length of the front wall and at least partially onto a lower portion of the side walls and extending downwardly from the lower portion of the front wall and the side walls to form a lower edge spaced apart from the floor surface; and a plurality of air openings projecting through the edge cleaning member.

2. The upright vacuum cleaner according to claim 1 wherein the edge cleaning member is further comprised of a flat elongated straight portion having opposing ends disposed on the lower portion of the front wall, and a pair of substantially curved side members joined to the ends and disposed on the lower portion of the side walls.

3. The upright vacuum cleaner according to claim 1 wherein the edge cleaning member is further comprised of a beveled portion extending substantially along the length of the member and inclined inwardly towards the intake nozzle, the beveled portion extending downwardly from the lower portion of the front wall and the side walls to form a lower apical edge spaced apart from the floor surface.

4. The upright vacuum cleaner according to claim 3 wherein the plurality of air openings project through the beveled portion and are disposed along the lower apical edge of the edge cleaning member.

5. The upright vacuum cleaner according to claim 4 wherein the air openings are substantially rectangular in shape.

6. The upright vacuum cleaner according to claim 4 wherein the air openings are substantially semicircular in shape.

7. The upright vacuum cleaner according to claim 4 wherein the air openings are substantially triangular in shape.

8. The upright vacuum cleaner according to claim 1 wherein the edge cleaning member is further comprised of an offset portion extending substantially along the length of the member, the offset projecting inwardly towards the intake nozzle and extending downwardly from the lower portion of the front wall and the side walls to form a lower offset edge spaced apart from the floor surface.

9. The upright vacuum cleaner according to claim 8 wherein the plurality of air openings project through the offset portion and are disposed along the lower offset edge of the edge cleaning member.

10. The upright vacuum cleaner according to claim 9 wherein the air openings are substantially rectangular in shape.

11. The upright vacuum cleaner according to claim 9 wherein the air openings are substantially semicircular in shape.

12. The upright vacuum cleaner according to claim 9 wherein the air openings are substantially triangular in shape.

13. The upright vacuum cleaner according to claim 1 wherein the edge cleaning member is further comprised of a polyurethane.

14. The upright vacuum cleaner according to claim 1 wherein the edge cleaning member is further comprised of polyvinychloride.

15. A flexible, resilient edge cleaning member for a floor cleaning device having a head assembly with a front wall, comprising:

an elongated section having an upper section with a front and a rear face, and a lower section with a front and a rear face, the rear face of the upper section being at least partially attached to the front wall of the vacuum cleaner and the front face projecting away from the front wall, the lower section extending downwardly from the upper section and having the front face of the lower section beveled inwardly towards the rear face of the lower section to form an apical lower edge spaced apart from the floor; and a plurality of air openings positioned along the apical lower edge and projecting through the lower section.

16. The edge cleaning member according to claim 15 wherein the plurality of air openings are substantially evenly spaced along the length of the straight elongated section.

17. The edge cleaning member according to claim 15 wherein the plurality of air openings are approximately rectangular in shape.

18. The edge cleaning member according to claim 15 wherein the plurality of air openings are approximately semicircular in shape.

19. The edge cleaning member according to claim 15 wherein the plurality of air openings are approximately triangular in shape.

20. The edge cleaning member according to claim 15 wherein the elongated section is further comprised of a polyurethane.

21. The edge cleaning member according to claim 15 wherein the elongated section is further comprised of polyvinylchloride.

22. A flexible, resilient edge cleaning member for a floor cleaning device having a head assembly with a front wall, comprising:

an elongated section having an upper section with a front face, a rear face, and a first thickness, a lower section with a front face, a rear face and a second thickness, the first thickness being greater than the second thickness, and the rear face of the upper section being at least partially attached to the front wall of the vacuum cleaner and the front face projecting away from the front wall, and the lower section extending downwardly from the upper section and having the front face of the lower section offset inwardly towards the rear face of the upper section to form a lower offset edge spaced apart from the floor; and a plurality of air openings positioned along the lower offset edge and projecting through the lower section.

23. The edge cleaning member according to claim 22 wherein the plurality of air openings are substantially evenly spaced along the length of the straight elongated section.

24. The edge cleaning member according to claim 22 wherein the plurality of air openings are approximately rectangular in shape.

25. The edge cleaning member according to claim 22 wherein the plurality of air openings are approximately semicircular in shape.

26. The edge cleaning member according to claim 22 wherein the plurality of air openings are approximately triangular in shape.

27. The edge cleaning member according to claim 22 wherein the elongated section is further comprised of a polyurethane.

28. The edge cleaning member according to claim 22 wherein the elongated section is further comprised of polyvinylchloride.

* * * * *